US005542259A

United States Patent [19]

Worek et al.

[11] Patent Number: 5,542,259

[45] Date of Patent: Aug. 6, 1996

[54] OPEN CYCLE DESICCANT COOLING PROCESS

[75] Inventors: William M. Worek, Downers Grove; Weixiang Zheng, Darien, both of Ill.

[73] Assignee: Gas Research Institute, Chicago, Ill.

[21] Appl. No.: 553,777

[22] Filed: Oct. 23, 1995

Related U.S. Application Data

[62] Division of Ser. No. 275,497, Jul. 15, 1994.

[51] Int. Cl.[6] ..... F25D 17/06

[52] U.S. Cl. ..... 62/94; 165/8; 34/80; 95/288

[58] Field of Search ..... 62/91, 92, 93, 62/94, 271; 34/72, 73, 75, 76, 80; 165/4, 8; 96/139, 143, 152; 55/269; 95/288

[56] References Cited

U.S. PATENT DOCUMENTS

| | | | |
|---|---|---|---|
| 3,247,679 | 4/1966 | Meckler | 62/94 |
| 3,774,374 | 11/1973 | Dufour et al. . | |
| 3,889,742 | 6/1975 | Rush et al. . | |
| 4,134,743 | 1/1979 | Macriss et al. . | |
| 4,497,361 | 2/1985 | Hajicek . | |
| 4,594,860 | 6/1986 | Coellner et al. . | |
| 4,729,774 | 3/1988 | Cohen et al. . | |
| 4,887,438 | 12/1989 | Meckler . | |
| 4,895,580 | 1/1990 | Morioka et al. . | |
| 4,926,618 | 5/1990 | Ratliff . | |
| 4,948,392 | 8/1990 | Rush . | |
| 5,167,679 | 12/1992 | Maekawa et al. . | |
| 5,170,633 | 12/1992 | Kaplan . | |
| 5,183,098 | 2/1993 | Chagnot . | |
| 5,325,676 | 7/1994 | Meckler | 62/94 |

OTHER PUBLICATIONS

R. K. Collier, Jr., D. Novosel and W. M. Worek, "Performance Analysis of Open–Cycle Desiccant Cooling Systems", ASHRAE Transactions 1990, V. 96, Pt. 1, AT 90–19–2, (1990).

W. M. Worek, W. Zheng, W. A. Belding, D. Novosel, W. D. Holeman, "Simulation of Advanced Gas–Fired Desiccant Cooling Systems", ASHRAE In–91–4–2, pp. 609–614, (1991).

*Primary Examiner*—John M. Sollecito

*Attorney, Agent, or Firm*—Speckman, Pauley & Fejer

[57] ABSTRACT

A process and apparatus for open cycle desiccant cooling wherein the process stream and regeneration stream are divided into a plurality of radial stream segments by non-parallel partitions forming unequal face segments in the desiccant wheel and the heat wheel for the same stream segment. The unequal face segments in the desiccant wheel and the heat wheel provide differing temperature profiles at the face of each wheel and allow obtaining desired temperature profiles for heat exchange and moisture adsorption. The process of this invention results in reduction of the radial speed of the heat wheel to less than 4 providing high effectiveness of the heat wheel increasing the capacity and the COP of the system.

11 Claims, 2 Drawing Sheets

OPEN CYCLE DESICCANT COOLING PROCESS

This is a divisional of copending application Ser. No. 08/275,497 filed on 15 Jul. 1994.

BACKGROUND OF THE INVENTION

1. Field of the Invention

This invention relates to an apparatus and process for improved efficiency of a sensible heat exchanger wheel in an open cycle desiccant cooling system. Diverging and converging partitions between the desiccant wheel and heat wheel in an open cycle desiccant cooling system provide unequal sized segments of the desiccant wheel and heat wheel exposed to process and regeneration gas streams in a manner which improves the efficiency of the heat wheel and allows reduction in rotational speed of the heat wheel to obtain high cooling efficiencies.

2. Description of Related Art

Rotary gas treating apparatus of a wide variety are known. U.S. Pat. Nos. 4,895,580 and 5,167,679 teach gas adsorption and desorption on regenerative rotary devices. Rotary dehumidifiers which are thermally regenerable are taught by U.S. Pat. Nos. 4,134,743 and 4,926,618. Rotary heat exchangers are taught by U.S. Pat. Nos. 4,497,361 and 5,183,098.

Open cycle desiccant cooling systems using rotary sensible heat exchanger wheels and regenerable desiccant wheels are well known, as exemplified by U.S. Pat. Nos. 3,889,742; 3,774,374; 4,729,774; 4,887,438; 4,948,392; 4,594,860; and 5,170,633. Staged heating of only the regeneration stream using parallel partitions between the heat wheel and the desiccant wheel forming equal sized segments of the heat wheel and desiccant wheel is taught by U.S. Pat. Nos. 3,889,742 and 4,948,392. Parallel partitions in the regeneration stream between the heat wheel and the desiccant wheel forming equal size segments in these wheels and parallel partitions in the process stream between the desiccant wheel and the heat wheel forming equal size segments in these wheels to obtain stratified inlet temperature to the heat wheel is taught by U.S. Pat. No. 4,594,860. Stratified heat recovery in the process steam to effect profiling of temperatures in the regeneration stream to obtain higher temperatures toward the hotter zone of a desiccant bed is taught be U.S. Pat. No. 4,729,774.

The emphasis for increased performance of open cycle desiccant cooling systems has focused on increasing the effectiveness of the desiccant wheel, as exemplified by R. K. Collier, Jr., D. Novosel and W. M. Worek, "Performance Analysis of Open-Cycle Desiccant Cooling Systems", ASHRAE Transactions 1990, V. 96, Pt. 1, AT 90-19-2, (1990) and W. M. Worek, W. Zheng, W. A. Belding, D. Novosel and W. D. Holeman, "Simulation of Advanced Gas-Fired Desiccant Cooling Systems", ASHRAE In-91-4-2, pg. 609–614, (1991).

SUMMARY OF THE INVENTION

Conventional open cycle cooling systems comprise a desiccant wheel and a heat wheel, which rotate in opposite directions, and an evaporative cooler with a process stream passing sequentially through a portion of the desiccant wheel, a portion of the heat wheel and an evaporative cooler and a counter flowing regenerative stream passing sequentially through an evaporative cooler, a portion of the heat wheel, and a portion of the desiccant wheel. The process stream after being dehumidified by the desiccant wheel, becomes warm and dry and is cooled by passing through the heat wheel which concurrently heats the regeneration stream for reactivation of the desiccant wheel. At least a portion of the regeneration stream may be further heated by an external source for passage through the desiccant wheel. The open cycle solid desiccant cooling system may be operated in a ventilation mode with at least a portion of the regeneration stream being outside air or in the recirculation mode with the regeneration stream being exclusively air from the cooled space.

The heat wheel is a critical element of the open cycle solid desiccant cooling system since if the heat wheel has low effectiveness, the system cooling capacity will be commensurately low, regardless of how dry the process air is dried by the desiccant wheel. The cooling capacity of a desiccant cooling system is basically controlled by the effectiveness of the heat wheel. Further, the more effective the heat wheel, a greater amount of heat will be recovered to heat the regeneration stream. Thus, both the cooling capacity and the coefficient of performance (COP) of the system are increased by more effective operation of the heat wheel.

It is an object of this invention to provide an apparatus and process for increasing the COP in an open cycle desiccant cooling system.

Another object of this invention is to provide an apparatus and process for increasing the system capacity in an open cycle desiccant cooling system.

Yet another object of this invention is to increase the effectiveness of the heat wheel in an open cycle desiccant cooling system.

These and other objects and advantages of this invention are achieved by non-parallel radial partitions in both the regeneration stream and the process stream creating unequal arcuate segments in the desiccant wheel and the heat wheel for each segment of the streams formed by such non-parallel partitions. By the terminology "non-parallel" as used in herein, it is meant that line segments parallel to the axis of the wheels in adjacent partitions are non-parallel with the adjacent partitions forming unequal cross sectional areas of the space between them at opposite ends. Improvement in the effectiveness of the heat wheel is further achieved by reducing the rotational speed of the heat wheel to a value significantly less than presently considered to be optimal.

Prior efforts to increase the efficiency of open cycle desiccant cooling systems have focused upon improvement in the effectiveness of the desiccant wheel. The present invention focuses on improvement in the effectiveness of the heat wheel to obtain both increased system capacity on increased COP.

The process of this invention for open cycle desiccant cooling is of the type wherein a process stream passes sequentially through a process stream arcuate segment of a rotating desiccant wheel, a process stream arcuate segment of an oppositely rotating heat wheel and an evaporative cooler to the cooled space and a countercurrent regeneration stream passes sequentially through an evaporative cooler, a regeneration stream arcuate segment of the heat wheel and a regeneration stream arcuate segment of the desiccant wheel. The improvement of this invention comprises dividing the process stream after passing through the desiccant wheel into a plurality of different temperature arcuate process stream segments, the total arcuate angle of the process stream outlet face segments in the desiccant wheel being greater than the total arcuate angle of the process stream inlet face segments in the heat wheel. The ducting forming the process stream is converging from the desiccant wheel to the heat wheel. Corresponding arcuate process stream segments have a different arcuate area at the outlet face of the desiccant wheel and the inlet face of the heat wheel to provide a temperature profile for improved effectiveness of the heat wheel. The process stream is divided into a gradation of high to low temperature process streams, the high temperature process stream(s) having a smaller face area than the low temperature process stream(s) due to the non-linear temperature change in the process stream at the outlet face of the desiccant wheel. Likewise, the medium and high temperature portions of the regeneration stream, after passing through the heat wheel, may be divided into a plurality of different temperature arcuate regeneration stream segments, the total arcuate angle of the medium and high temperature outlet face segments in the heat wheel being less than the total arcuate angle of the regeneration stream inlet face segments in the desiccant wheel. The ducting forming the medium and high temperature regeneration streams is diverging from the heat wheel to the desiccant wheel.

The apparatus of this invention for open cycle desiccant cooling is of the type having a rotating desiccant wheel, an oppositely rotating heat wheel and ducting means capable of passing a process stream sequentially through a process stream arcuate segment of the desiccant wheel, a process stream arcuate segment of the heat wheel and an evaporative cooler to a cooled space and capable of passing a regeneration stream countercurrent to the process stream sequentially through an evaporative cooler, a regeneration stream arcuate segment of the heat wheel and a regeneration stream arcuate segment of the desiccant wheel. The improvement of this invention comprises the ducting means forming the process stream being converging from the desiccant wheel to the heat wheel forming a plurality of arcuate process stream outlet face segments at the outlet face of the desiccant wheel and forming a plurality of arcuate process stream inlet face segments at the inlet face of the heat wheel. Likewise, the ducting means forming the medium and high temperature regeneration stream may be diverging from the heat wheel to the desiccant wheel forming a plurality of arcuate regeneration stream outlet face segments at the outlet face of the heat wheel and forming a plurality of arcuate regeneration stream inlet face segments at the inlet face of the desiccant wheel.

BRIEF DESCRIPTION OF THE DRAWINGS

The above and other advantages of this invention will become evident upon descriptions of specific preferred embodiments and reference to the drawings, wherein.

DESCRIPTION OF PREFERRED EMBODIMENTS

Figure 1:
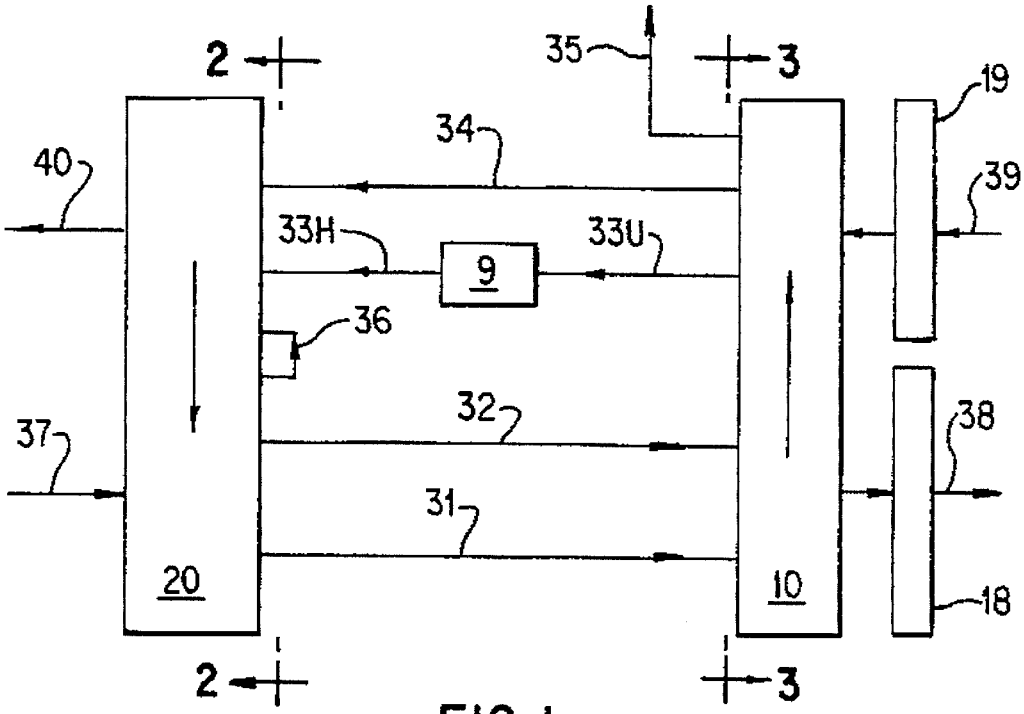
FIG. 1 is a schematic top view of a portion of an open cycle desiccant cooling system according to one embodiment of this invention.
Figure 2:
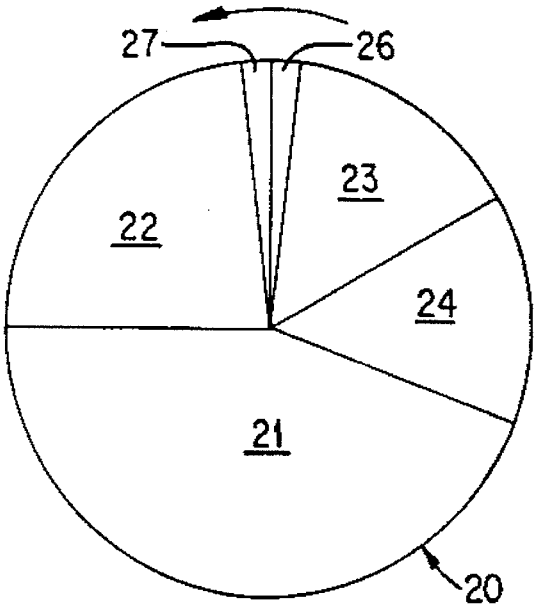
FIG. 2 is a schematic showing of one face of the desiccant wheel as shown in FIG. 1 by Section 2—2.
Figure 3:
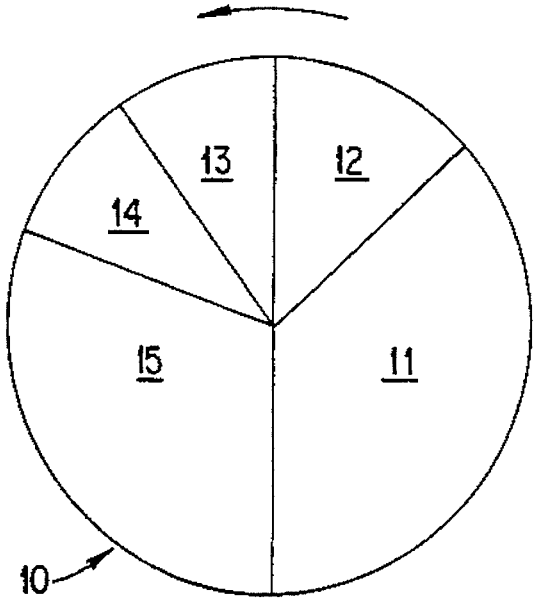
FIG. 3 is a schematic showing of one face of the heat wheel as shown in FIG. 1 by Section 3—3.
Figure 4:
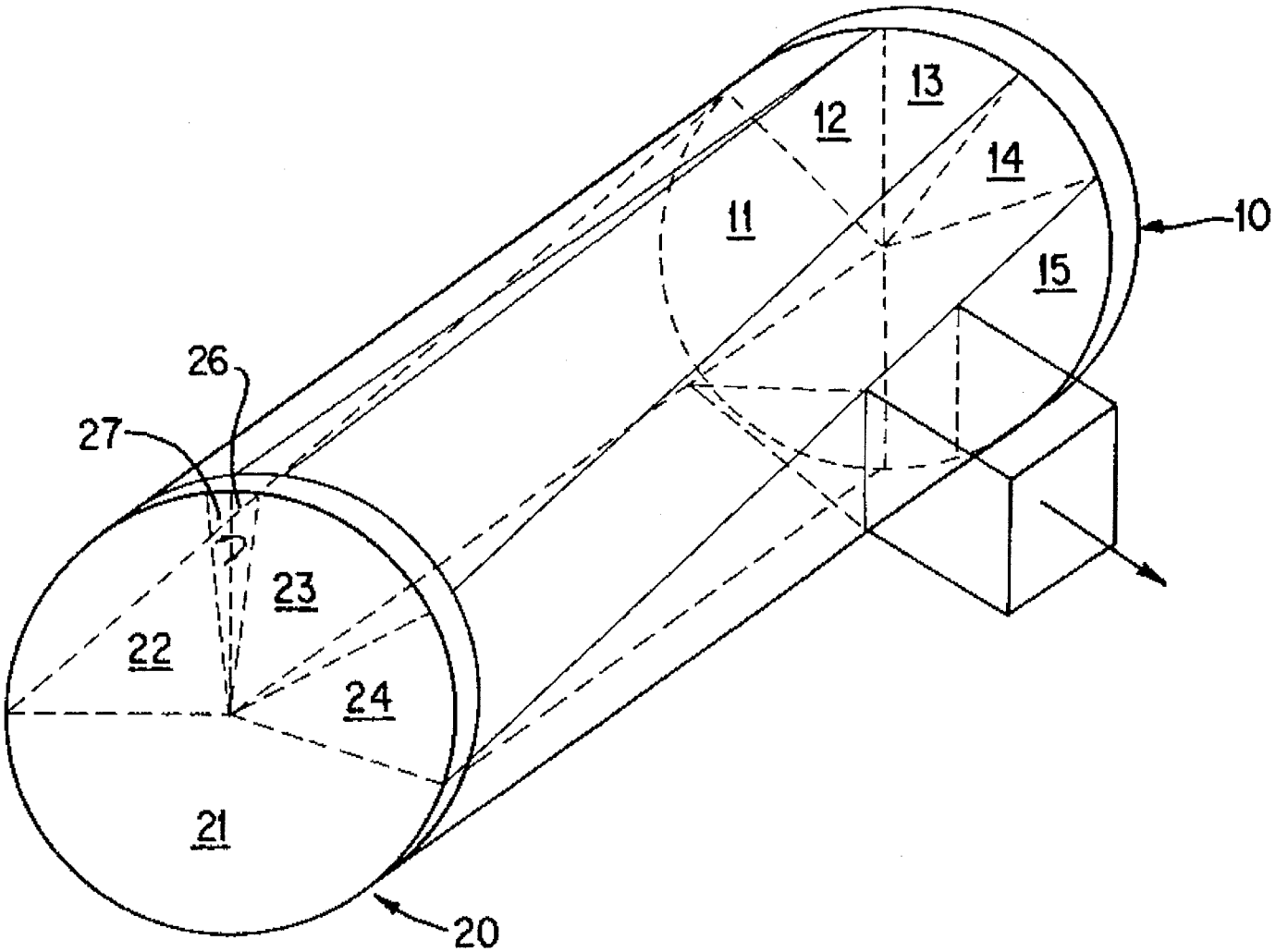
FIG. 4 is a perspective view of non-parallel radial partitions which extend between the desiccant wheel and the heat wheel, according to one preferred embodiment of this invention.

Referring to FIG. 1, an open cycle desiccant cooling system according to one embodiment of this invention is shown in a simplified schematic form. Process stream input 37 passes to the process stream input face of desiccant wheel 20, through desiccant wheel 20 drying the process stream, and exits desiccant wheel 20 through the opposite process stream output face of desiccant wheel 20. At the process stream output face of desiccant wheel 20, low temperature process stream face segment 21 and high temperature process stream face segment 22, as best seen in FIG. 2, form low temperature process stream segment 31 and high temperature process stream segment 32, respectively, defined by non-parallel radial partitions which extend between desiccant wheel 20 and heat wheel 10, as shown in FIG. 4. These process stream segments pass to the process stream input face of heat wheel 10 with low temperature process stream segment 31 passing through low temperature process stream face segment 11 of the process stream input face of heat wheel 10 and high temperature process stream segment 32 passing through high temperature process stream face segment 12 of the input face of heat wheel 10, as best seen in FIG. 3. The total arcuate angle of low temperature process stream face segment 21 and high temperature process stream face segment 22 of the output face of desiccant wheel 20 is greater than that of low temperature process stream face segment 11 and high temperature process stream face segment 12 of the input face of heat wheel 10 forming a converging process stream from desiccant wheel 20 to heat wheel 10. The converging ratio is the ratio of the total angle of the process stream outlet face segments 21 and 22 of the desiccant wheel to that of the process stream inlet face segments 11 and 12 of the heat wheel. In system design, the converging ratio between the face segment 22 and the face segment 12 and the converging ratio between the face segment 21 and the face segment 11 are about equal. The converging ratio is suitable just over 1.0 to about 1.67, preferably about 1.15 to about 1.3. The entire process stream is cooled passing through heat wheel 10 and humidified by passing through process stream evaporative cooler 18 to form process stream cool output 38. Heat wheel 10 and desiccant wheel 20 rotate in opposite directions as shown by the arrows.

Regeneration stream input 39 passes through regeneration stream evaporative cooler 19 to the regeneration stream input face of heat wheel 10, through heat wheel 10 heating the regeneration stream, and exits heat wheel 10 through the opposite regeneration stream output face of heat wheel 10. At the regeneration stream output face of heat wheel 10, high temperature regeneration face segment 13, medium temperature regeneration face segment 14 and low temperature regeneration face segment 15, as best seen in FIG. 3, form high temperature regeneration stream segment 33U, medium temperature regeneration stream segment 34 and low temperature regeneration stream scavenger segment 35, respectively, defined by non-parallel partitions. Regeneration stream scavenger segment 35 may be discharged from the system. Medium temperature regeneration stream segment 34 passes directly to regeneration stream input face of desiccant wheel 20 and passes through medium temperature regeneration stream face segment 24. High temperature regeneration stream segment 33U passes through heating means 9 further heating this stream segment to form heated high temperature regeneration stream segment 33H which passes through heated high temperature regeneration stream face segment 23 of the regeneration stream input face of desiccant wheel 20. The total arcuate angle of high temperature regeneration stream face segment 13 and medium temperature regeneration stream face segment 14 of the output face of heat wheel 10 is less than that of high temperature regeneration stream face segment 23 and medium temperature face segment 24 of the input face of desiccant wheel 20 forming a divergent regeneration stream from heat wheel 10 to desiccant wheel 20. The diverging ratio is the ratio of the total angle of the high and medium temperature regeneration stream outlet face segments 13 and 14 of the heat wheel 10 to that of regeneration stream inlet face segments 23 and 24 of desiccant wheel 20. In system design, the diverging ratio between face segment 13 and face segment 23 and the diverging ratio between face segment 14 and face segment 24 are about equal. The diverging ratio is suitably just over 1.0 to about 2.5, preferably about 1.5 to about 2.0. Passing through desiccant wheel 20 the regeneration stream heats the regeneration segments to regenerate the desiccant within that portion of desiccant wheel 20 and pass from regeneration stream exhaust face of the wheel as regeneration stream exhaust 40.

A purge stream may be passed through desiccant wheel 20 by passing through purge stream inlet face segment 27 forming purge stream 36 which is passed back through desiccant wheel 20 through purge stream outlet face segment 26 to cool these segments of desiccant wheel 20 prior to entry of process stream 37.

Process stream input 37 may be from outside the cooled space to operate the system in the ventilation mode or may be from inside the cooled space to operate the system in the recirculation mode, or may be any combination of these sources. The process stream is dehumidified by passing through desiccant wheel 20 and the process stream temperature upon passing from the outlet face of the desiccant wheel has a profile which is a function of the arc segment of the wheel through which it passed, with the highest temperature being adjacent to the purging stream. The temperature profile is maintained by partitions in the process stream between the desiccant wheel and the heat wheel. In this invention, the arcuate temperature profile of the process stream may be modified between the process stream outlet face of the desiccant wheel and the process stream inlet face of the heat wheel to obtain high effectiveness of the heat wheel. As shown in FIG. 2, the process stream outlet face of desiccant wheel 20 is divided into high temperature process stream face segment 22 and low temperature process stream face segment 21 while, as shown in FIG. 3, the process stream inlet face of heat wheel 10 is divided into high temperature process stream face segment 12 and low temperature process stream face segment 11. The process stream arcuate segments at the outlet face of the desiccant wheel and the inlet face of the heat wheel are of unequal sizes which may be adjusted to obtain high effectiveness of the heat wheel. These unequal arcuate segments are formed by non-parallel radial partitions between desiccant wheel 20 and heat wheel 10 resulting in different process stream arcuate temperature profiles adjacent each wheel. In this manner, the desired temperature profile for high effectiveness of the heat wheel may be obtained. The ducting for process stream input 37 is matched to the total arcuate segment of the process stream through desiccant wheel 20 and for process stream treated output 38 is matched to the total arcuate segment of the process stream through heat wheel 10. While the figures show two segments 31 and 32 of the process stream and corresponding two segments in desiccant wheel 20 and heat wheel 10, it should be recognized that any desired number of segments may be formed in a similar manner to obtain the desired temperature profile, generally two to about four segments being suitable. It is generally desired that the arcuate segments of high temperature process stream 32 and low temperature process stream 31 be reduced between the process stream outlet face of desiccant wheel 20 and the process stream inlet face of heat wheel 10. Since the total arcuate angle on the process side of the desiccant wheel may be varied in different designs, the arcuate segments of the process stream will be defined as arcuate angle fractions of the total process stream input 37. The arcuate angle fraction of high temperature process stream face segment 22 to the total arcuate angle of process stream input 37 is suitably about 0.1 to about 0.4, preferably about 0.15 to about 0.25.

Regeneration stream input 39 is ambient air directed, countercurrent to the process stream, through regeneration stream evaporative cooler 19 and through heat wheel 10 to exit through regeneration stream arcuate outlet face segments of heat wheel 10 shown as 12, 13 and 14 in FIG. 3. The regeneration stream is warmed by passing through heat wheel 10 and the regeneration stream temperature upon passing from the outlet face of the heat wheel has a profile which is a function of the arc segment of the wheel through which it is passed, with the highest temperature being adjacent the high temperature process stream segment, as seen in FIG. 3. The temperature profile in the regeneration stream is maintained by partitions in the regeneration stream between the heat wheel and the desiccant wheel. In this invention, the arcuate temperature profile of the regeneration stream may be modified between the outlet face of the heat wheel and the inlet face of the desiccant wheel. As shown in FIG. 3, the regeneration stream outlet face of heat wheel 10 is divided into high temperature regeneration stream outlet face segment 13, medium temperature regeneration stream outlet face segment 14 and low temperature regeneration stream outlet face segment 15 while, as shown in FIG. 2, the regeneration stream inlet face of desiccant wheel 20 is divided into medium temperature regeneration stream inlet face segment 24 and high temperature regeneration stream inlet face segment 23. The regeneration stream arcuate segments at the outlet face of the heat wheel and the inlet face of the regeneration wheel are of unequal sizes which may be adjusted to obtain high effectiveness of regeneration of the desiccant wheel. The portion of the regeneration stream formed by low temperature regeneration face segment 15 is regeneration stream scavenger segment 35 which is discarded from the system, as shown in FIG. 1, thereby reducing the heat input necessary to obtain the same regeneration temperature. Medium temperature regeneration stream 34 formed by medium temperature regeneration stream outlet face segment 24 is passed directly to medium temperature regeneration stream inlet face segment of regeneration wheel 20, as shown in the figures. High temperature regeneration stream 33U, unheated by an external source, is passed through heating means 9, providing heat from an external source, further heating the stream segment to the desired temperature for heated high temperature regeneration stream 33H which is passed through high temperature regeneration stream inlet face segment 13 of desiccant wheel 20. Thus, it is seen that the regeneration stream arcuate segments of the outlet face of the heat wheel and the inlet face of the regeneration wheel are of unequal sizes which may be adjusted to obtain desired temperature profiles for high effectiveness of both the heat wheel and regeneration of the desiccant wheel. These unequal arcuate segments are formed by non-parallel partitions in the regeneration stream between the outlet of heat wheel 10 and the inlet of desiccant wheel 20 resulting in different regeneration stream arcuate temperature profiles adjacent each wheel. Suitable ducting is provided for discharging regeneration scavenger stream 35 and ducting for exhaust stream 40 may be matched to the total arcuate segment of the regeneration stream passing through desiccant wheel 20. Heating means 9 may be any suitable heating means known to the art, such as a gas burner. Again, while the figures show two segments 33 and 34 of the regeneration stream passing from the regeneration stream outlet of heat wheel 10 to the regeneration stream inlet of desiccant wheel 10, it should be recognized that any number of segments may be formed in a similar manner to obtain the desired temperature profile. Medium temperature regeneration stream 34 may be divided into up to about four segments to obtain a desired temperature profile at the regeneration stream input face of desiccant wheel 20. High temperature regeneration stream 33U between the regeneration stream outlet face of heat wheel 10 and heating means 9 may be divided into up to four segments to further reduce external heat requirements, and high temperature regeneration stream 33H between heating means 9 and regeneration stream inlet face segment 23 of desiccant wheel 20 may be divided into up to four segments to obtain preferred high regeneration stream temperature profiles in desiccant wheel 20. Heating means 9 may be used to further heat specific stream segments selectively to provide further temperature profile control. It is generally desired that the cross sectional area of arcuate segments of high temperature regeneration stream 33U and 33H and of medium temperature regeneration stream 34 be increased between the regeneration stream outlet face of heat wheel 10 and the regeneration stream inlet face of desiccant wheel 10. Since the total arcuate angle on the regeneration side of the desiccant wheel may be varied in different designs, the arcuate segments of the regeneration stream will be defined as arcuate angle fractions of the total regeneration stream output 40. The arcuate angle fraction of high temperature regeneration stream face segment 23 to the total arcuate angle of regeneration stream exhaust 40 is suitably about 0.4 to about 0.8, preferably about 0.50 to about 0.67.

Purge stream 36 may be provided between the regeneration stream and the process stream segments of the regeneration wheel to cool the wheel and to remove flue gases of an open burner to render more effective desiccation of the process stream. As shown in FIG. 2, the purge stream passes through purge stream inlet face segment 27 and purge stream outlet face segment 26 following the path shown in FIG. 1.

The rotational speeds of both the heat wheel and the desiccant wheel depend upon many design and operating parameters. The rotational speed of the desiccant wheel, for high system performance, is very sensitive to the desiccant material used, the size of the desiccant wheel, the heat and mass transfer in the desiccant wheel, the regeneration temperature, the inlet process stream temperature and humidity, as well as other variables. The heat wheel similarly depends upon many design and operating parameters. The rotational speeds of both the desiccant wheel and the heat wheel, and the interaction of these two rotational speeds, are important to obtain high system performance. For given system conditions, under-adsorption and over-adsorption in the desiccant wheel are controlled by the rotational speed of the wheel as well as the size of the wheel arcuate segment through which the process stream passes. Likewise, the heat wheel can provide greater cooling effect to the process stream at a rotational speed and size of arcuate segments through which a process stream having desired temperature profile passes. The greater cooling of the process stream by the heat wheel also provides higher temperature regeneration stream segments for regeneration of the desiccant wheel. To achieve high system efficiency, each of the heat wheel and the desiccant wheel must operate at a rotational speed providing high efficiency in the respective wheel. This invention provides unequal stream face segments for the desiccant and heat wheels for a specified stream segment which allows greater flexibility in matching the relative rotational speeds of the wheels. According to this invention, desired nondimensional rotational speeds of the heat wheel are in the order of about 1 to about 4, much less than the minimum of 5 taught by heat wheel design books and papers. The lower desired rotational speed of the heat wheel creates a more stratified temperature profile for the outlet of the regeneration stream from the heat wheel to yield a higher temperature regeneration stream. For the above reasons, it is not practical to specify absolute rotational speeds for the heat wheel and the desiccant wheel. However, computer modeling has shown that the ability to provide unequal stream face segments for the desiccant and heat wheels for a specific stream segment results in reduction in the speed of both the desiccant and the heat wheel for high efficiency performance, as compared to prior systems having equal stream face segments for the desiccant and heat wheels for a specific stream segment. Generally, using the process and apparatus of this invention, high efficiency performance is obtained by reducing the rotational speed of the heat wheel by a factor of about 2.5 and reducing the rotational speed of the desiccant wheel by a factor of about 2, as compared to prior systems having equal stream face segments for the desiccant and heat wheels for a specific stream segment. Under such operating parameters, the performance of the system (COP) is improved about 45 percent by use of the apparatus and process of this invention.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. In a process for open cycle desiccant cooling of the type wherein a process stream passes sequentially through a process stream arcuate segment of a rotating desiccant wheel, a process stream arcuate segment of an oppositely rotating heat wheel and an evaporative cooler to the cooled space and a countercurrent regeneration stream passes sequentially through an evaporative cooler, a regeneration stream arcuate segment of said heat wheel and a regeneration stream arcuate segment of said desiccant wheel, the improvement comprising; dividing said process stream after passing through said desiccant wheel into a plurality of different temperature arcuate process stream segments, corresponding said arcuate process stream segments having a different arcuate area at the outlet face of said desiccant wheel and the inlet face of said heat wheel to provide a temperature profile for improved effectiveness of said heat wheel.

2. In a process according to claim 1 wherein the arcuate area of said process stream at said inlet face of said heat wheel is larger than the arcuate area of said process stream at said outlet face of said desiccant wheel.

3. In a process according to claim 1 wherein said heat wheel is rotated at a nondimensional rotational speed of less than 4.

4. In a process according to claim 1 wherein high temperature process stream segment(s) comprise arcuate angle fractions of said desiccant wheel of about 0.1 to about 0.4 of the total arcuate angle of said process stream passing through said desiccant wheel.

5. In a process according to claim 1 wherein said process stream has a converging ratio of just over 1.0 to about 1.67 passing from said outlet face of said desiccant wheel to said inlet face of said heat wheel.

6. In a process according to claim 1 further comprising dividing said regeneration stream after passing through said heat wheel into a plurality of different temperature arcuate regeneration stream segments, said arcuate regeneration stream segment having different arcuate area at the outlet face of said heat wheel and the inlet face of said desiccant wheel to provide utilization of a greater amount of heat from said heat wheel in staged temperature profile for said desiccant wheel.

7. In a process according to claim 6 wherein the highest temperature said arcuate regeneration stream segment(s) is(are) further heated by heat from a source exterior to said process.

8. In a process according to claim 7 wherein said arcuate regeneration stream segment(s) further heated comprise arcuate angle fraction(s) of said desiccant wheel of about 0.5 to about 0.67 of the total arcuate angle of said regeneration stream passing through said desiccant wheel.

9. In a process according to claim 6 wherein said regeneration stream arcuate area at said inlet face of said desiccant wheel is larger than said regeneration stream arcuate area at said outlet face of said heat wheel.

10. In a process according to claim 9 wherein the lowest temperature said arcuate regeneration stream segment(s) is(are) discharged from said process.

11. In a process according to claim 6 wherein said regeneration stream has a diverging ratio of just over 1 to about 2.5 passing from said outlet face of said heat wheel to said inlet face of said desiccant wheel.

* * * * *